US006345996B2

(12) United States Patent
Saito et al.

(10) Patent No.: US 6,345,996 B2
(45) Date of Patent: Feb. 12, 2002

(54) CONNECTOR ENGAGING/DISENGAGING DEVICE HAVING CARRIER PLATES CARRYING CABLE CONNECTORS MOVED BY THE USE OF SLIDERS

(75) Inventors: Kazuki Saito, Akishima; Shin Kamiyamane, Tokyo, both of (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/770,333

(22) Filed: Jan. 26, 2001

(30) Foreign Application Priority Data

Jan. 26, 2000 (JP) ..... 12-016906

(51) Int. Cl.[7] ..... H01R 13/62
(52) U.S. Cl. ..... 439/159; 439/540.1
(58) Field of Search ..... 439/157, 352, 439/355, 347, 717, 540.1, 532, 701, 79, 710, 310, 159

(56) References Cited

U.S. PATENT DOCUMENTS 3,867,000 A * 2/1975 Michalak et al. ..... 439/355
RE29,780 E * 9/1978 Rutkowski et al. ..... 339/91
5,658,154 A * 8/1997 Bumsted et al. ..... 439/79
5,779,504 A * 7/1998 Dominiak et al. ..... 439/709
5,795,174 A * 8/1998 Saito et al. ..... 439/310
5,860,816 A * 1/1999 Provencher et al. ..... 439/79
6,027,369 A * 2/2000 Conorich et al. ..... 439/532
6,149,447 A * 11/2000 Maeda et al. ..... 439/157

FOREIGN PATENT DOCUMENTS

EP 0 901 294 A2 3/1999 ..... H04Q/1/14
EP 0 041 677 A1 10/2000 ..... H01R/13/518

* cited by examiner

*Primary Examiner*—Gary Paumen
*Assistant Examiner*—Alexander Gilman
(74) *Attorney, Agent, or Firm*—Michael Best & Friedrich LLC; J. Warren Whitesel

(57) ABSTRACT

A connector engaging/disengaging device comprises a plurality of carrier plates, a pair of side blocks, and a pair of sliders. Each of the carrier plates has lock springs holding cable connectors thereon, and a pair of engaging bosses engaging with the sliders. The sliders have slider grooves engaging with the bosses. Each of the side blocks supports each of said carrier plates slidable in vertical direction, and guides each of said sliders in horizontal direction, and supports a printed circuit board having mating connectors thereon. When the sliders slide in the horizontal-direction, slider grooves of the sliders push up or down the carrier plates to connect or disconnect cable connectors to the mating connectors.

7 Claims, 8 Drawing Sheets

CONNECTOR ENGAGING/DISENGAGING DEVICE HAVING CARRIER PLATES CARRYING CABLE CONNECTORS MOVED BY THE USE OF SLIDERS

BACKGROUND OF THE INVENTION

This invention relates to a connector engaging/disengaging device for engaging and disengaging a plurality of electrical connectors (which will simply be referred to as "connectors") to and from a plurality of mating connectors and, in particular, to a connector engaging/disengaging device for engaging and disengaging a plurality of connectors connected to a plurality of cables to and from a plurality of mating connectors mounted on a printed circuit board for the purpose of data transmission between electronic components.

In existing electronic apparatus, electrical cables (which will simply be referred to as "cables") are used for transmitting signals between electronic parts and connectors are used for electronic connection between the cables and the parts. For example, in order to electrically connecting a particular one of printed circuit boards with other ones of the printed circuit boards and/or electrical elements through cables, connectors are mounted on the particular circuit board, while the cables are led out from the other printed circuit boards and the electrical elements and mounted with cable connectors at their ends. The cable connectors are engaged with corresponding ones of the connectors mounted on the particular printed circuit board. Each of the cables often has a plurality of conductor lines, although it has a single conductor line. Accordingly, each of cable connectors has a plurality of contacts or a single contact. In a case, a plurality of cables are accommodated in a single cable connector having a plurality of contacts. Each of the connectors mounted on the particular printed circuit board has a number of contacts equal to the number of contacts in the corresponding one of the cable connectors.

When carrying out wiring operation in a housing of an electronic apparatus, it is necessary to engage and connect connectors to each other. Since the engaging operation is usually performed by use of hands, the housing is required to have a relatively large space sufficient to enables the manual operation in the housing. This results in demand of a relatively large-size housing to be used.

In recent electronic apparatus, especially, computers, electronic parts used have been increased in number, and therefore, cables and connectors have also been increased in number. Further, for the demand of small-size of the apparatus itself and of reduction of signal transmission time, it is required that the housing is small-sized, parts being mounted in small mounting density, and cables being reduced in length. Therefore, on one hand, the wiring operation becomes more difficult because manual operation for engaging connectors to each other must be an reduced space in the housing, and, on the other hand, insurance of the manual operation of the wiring make it difficult to small size the apparatus.

SUMMARY OF THE INVENTION

It is an object of this invention to provide a connector engaging/disengaging device which is capable of easily and rapidly engaging/disengaging a number of connectors accommodated in a small frame and a number of mating connectors mounted on a circuit board.

According to this invention, there is provided a connector engaging/disengaging device for connecting/disconnecting between first electrical connectors and second electrical connectors. The device comprises: at least one carrier plate adapted to carry the first electrical connectors thereon and having opposite end portions in a first direction, the end portions having engaging bosses projecting from the end portions in the first direction; a support member supporting the at lest one carrier plate slidable in a second direction perpendicular to the first direction and having slider guide grooves extending in a third direction perpendicular to the first and second direction, the support member having support portions adapted to support the second connectors so that the second electrical connectors face the first electrical connectors carried on the at least one carrier plate; and a pair of slider rods assembled in the support members slidable in the slider guide grooves in the third direction, the slider rods having slider grooves engaging the engaging bosses of the at lest one carrier plate so that the at least one carrier plate is moved in the second direction by slide of the slider rods in the third direction so as to perform connection and disconnection of the first electrical connectors with the second electrical connectors.

According to an embodiment, each of the slider groove comprises a first straight groove portion extending in the third direction, second straight groove portion extending in the third direction but offset from the first straight groove portion in the second direction, and an inclined groove portion connecting between the first straight groove portion and the second straight groove portion.

According to another embodiment, the first electrical connectors are cable connectors and the second electrical connectors are header connectors mounted on a printed circuit board.

According to an embodiment, the support portions of the support member are support flanges, the printed circuit board having a pair of flanges fixed at opposite sides thereof and a pair of L-shaped guide portions fixedly mounted on the flanges to form gaps between the flanges and foots of "L" of the L-shaped guide portions, the printed circuit board is attached to the support member by the support flanges of the support members being inserted in the gaps.

In an embodiment, the shape of the at least one carrier plate is in a generally rectangular form having an upper side and a lower side in the second direction and opposite ends in the first direction, the carrier plate has a generally U-shaped locking spring at the center thereof in the first direction and generally L-shaped locking springs at both the ends thereof, a first stopper on the lower side at the center in the first direction and second stoppers on the lower side at both the ends thereof, the carrier plate further having generally L-shaped projecting portions formed at the both end portions with the bosses being fixed on the projecting portions, respectively.

In a preferred embodiment, the support member comprising a pair of side blocks, and a front plate fixed onto front surfaces of the side blocks to thereby joint the side blocks.

Each of the side blocks has vertical guide grooves in the second direction and receiving the L-shaped projecting portions slidable therein in the second direction, stopper plates are fixedly mounted onto the side blocks to prevent the L-shaped projecting portions from going out of the vertical guide grooves.

DESCRIPTION OF THE PREFERRED EMBODIMENT

Referring now to FIGS. 1 to 11, the description will proceed to a device for engaging/disengaging cable connectors with connectors on printed circuit board or a card according to a preferred embodiment of this invention.

Figure 1:
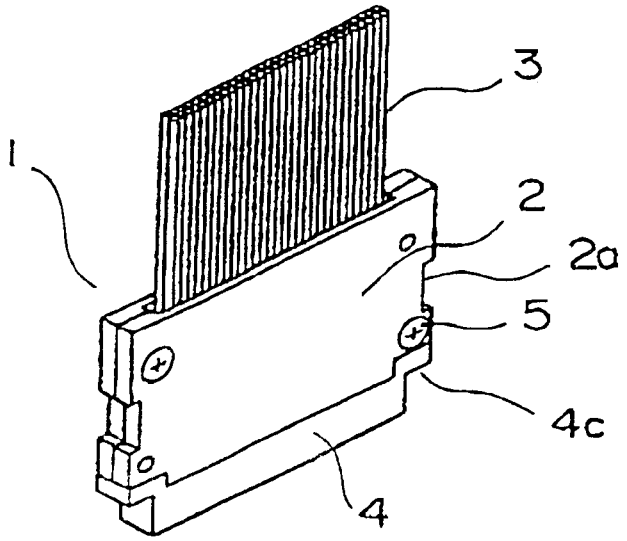
FIG. 1 is a perspective view of a cable connector used in a connector engaging/disengaging device an embodiment of this invention.

Referring to FIG. 1, a cable connector 1 comprises an insulator housing 2 having a cable introducing hole at an upper end and a fitting portion 4 at the opposite or lower end, and a plurality of contact elements (not shown) fixed in the insulator housing 2. A plurality of cables 3 are introduced in the insulator housing 2 and electrically and mechanically connected to the contact elements. The fitting end 4 is fitted and engaged with a mating connector. The insulator housing 2 has two locking grooves 2*a* at opposite side ends and two stopping grooves 4*c* in a lower end surface. In FIG. 1, the insulator housing 2 is shown to be formed of two similar insulators fixed to each other by screws 5.

Figure 2:
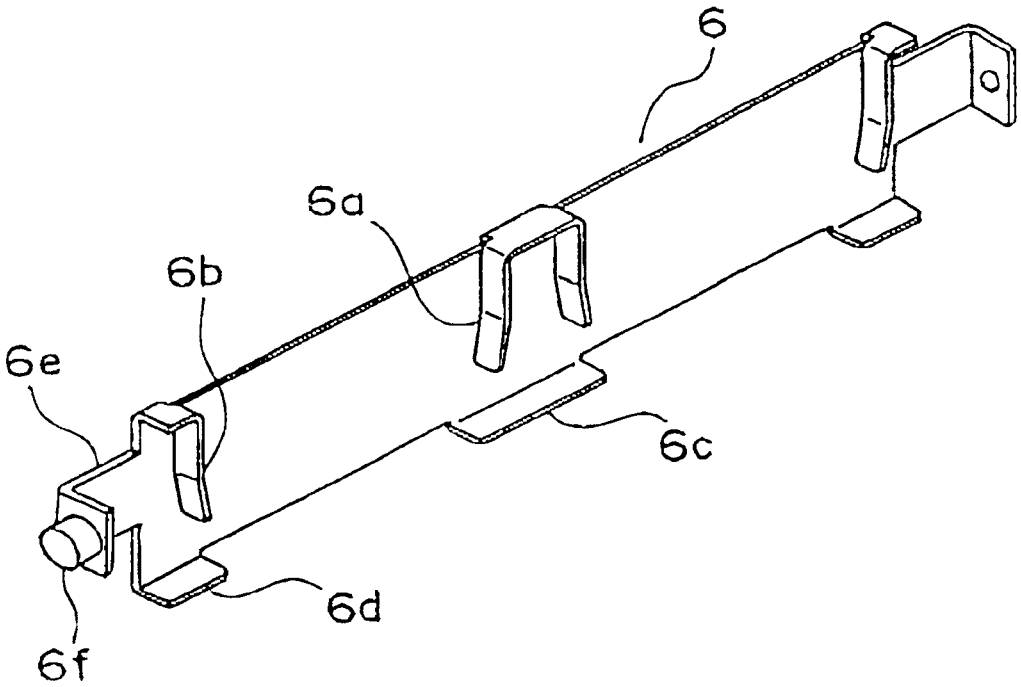
FIG. 2 is a perspective view of a carrier plate in the connector engaging/disengaging device according to the embodiment of this invention.

The connector engaging/disengaging device of this invention comprises a carrier assembly for carrying cable connectors having carrier plates. Referring to FIG. 2, a carrier plate 6 is generally rectangular in the shape. The carrier plate 6 has a generally U-shaped locking spring (preserving portion) 6*a* on its surface at the central portion in the transverse direction thereof and fixed to the upper side of the rectangular, and two generally L-shaped locking springs (preserving portions) 6*b* at opposite end portions of the rectangular, respectively, by bending the plate. The carrier plate 6 further has, on a lower side, a stopper (positioning portion) 6*c* at the center in the transverse direction thereof and two small stoppers (positioning portions) 6*d* at opposite end portions thereof, respectively, by bending the plate. The carrier plate 6 further has generally L-shaped projecting portions 6*e* which project from opposite ends of the rectangular. A boss (protrudent portion) 6*f* is press-fitted and fixed onto each of the L-shaped projecting portions 6*e*.

Figure 3:
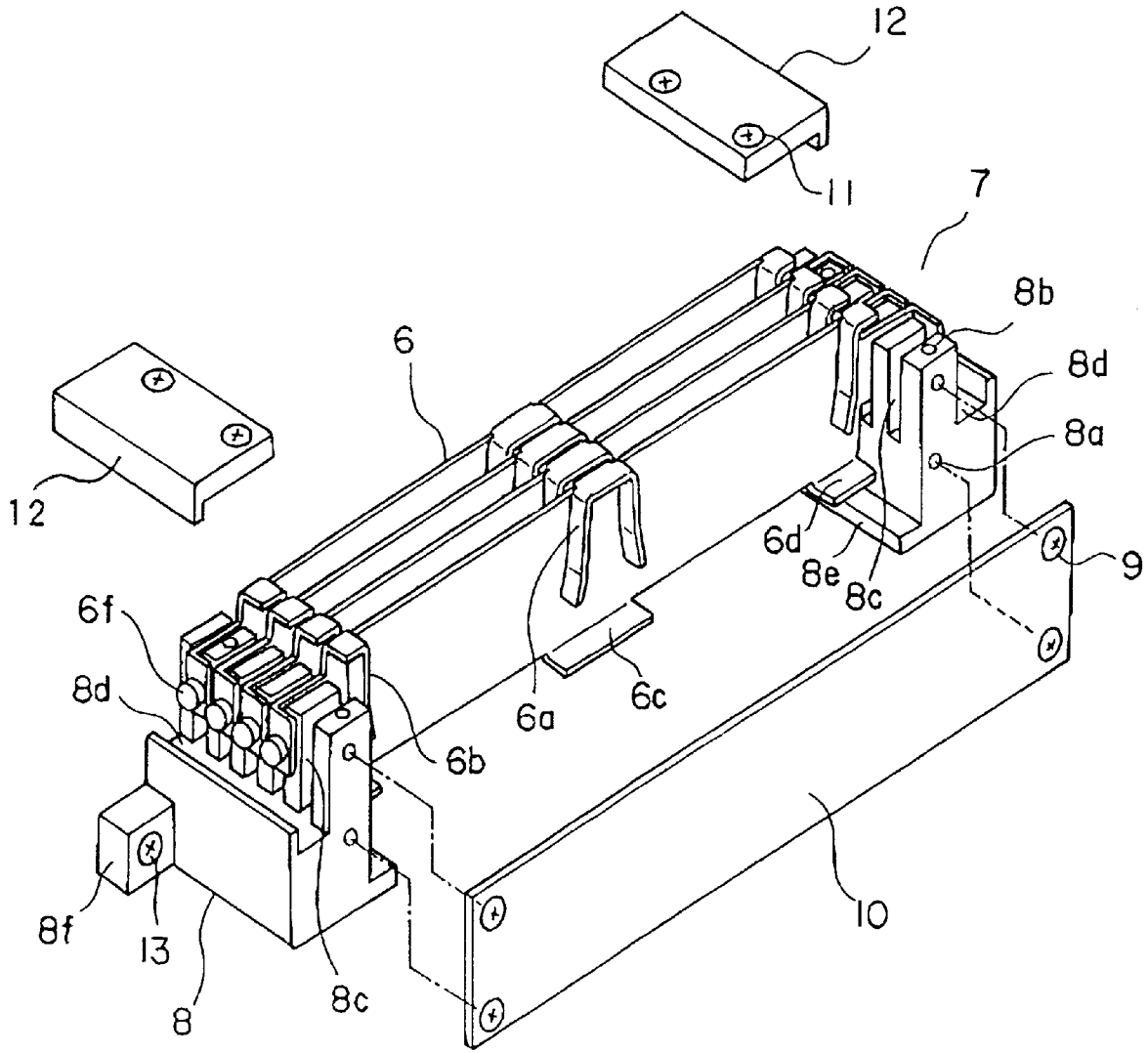
FIG. 3 is a perspective view showing a disassembled state of a carrier assembly in the connector engaging/disengaging device according to the embodiment of this invention.

Referring to FIG. 3, the carrier assembly 7 comprises a plurality of the carrier plates 6, a pair of side blocks 8 for supporting opposite ends of carrier plates 6, a front plate 10 fixed to a front surface of each of the side blocks 8, and a pair of upper plates 12 fixed to an upper surface of each of the side blocks. The opposite end portion of the front plate 10 is fixed to the side blocks 8 by screws 9 fastened therethrough to screw holes 8*a* in the front surface of the side blocks 8. The upper plates 12 are also fixed to the side blocks 8 by means of screws 11 fastened therethrough to screw holes 8*b* on the upper surface of the side blocks 8.

The side blocks 8 further have a plurality of vertical guide grooves (preserving portions for driving) 8*c* formed at regular intervals in the upper half wall portion of each side block 8. Projecting portions 6*e* of carrier plates 6 are inserted into corresponding ones of the guide grooves 8*c* and vertically slidable in the vertical guide groove 8*c*. However, the projecting portions 6*e* are prevented from falling off from the vertical grooves 8*c* upwardly by the upper plates 12. The side blocks 8 further have horizontal guide grooves 8*d* formed outside and adjacent the vertical guide grooves 8*c* and extending from the front to the rear of the side blocks 8. The side blocks 8 further have support flange (support portion) 8*e* projecting inwardly from the lower inside portions of the side blocks 8 for supporting the card.

Figure 4:
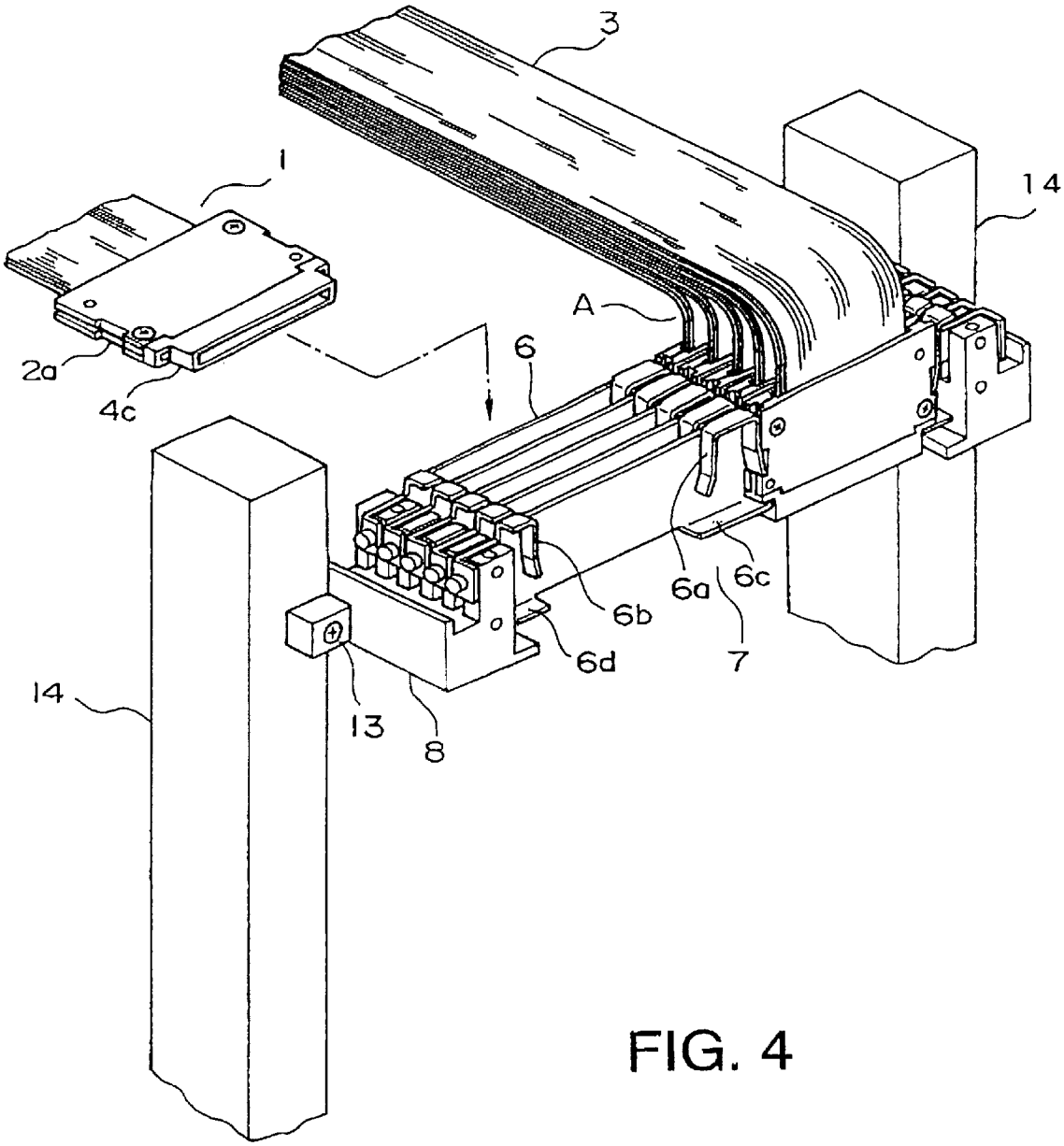
FIG. 4 is a perspective view showing the carrier assembly mounted on at a pair of pillars with cable connector being supported on the carrier plates.

The side blocks 8 further have mounting tabs 8*f* on the outside thereof by which the carrier assembly 7 is fixedly mounted on mounting pillars 14 by means of screws 13 as seen in FIG. 4.

As shown in FIG. 4, cable connectors 1 are mounted on carrier plates 6 successively. Opposite locking grooves 2*a* of each cable connector 1 engage with one side of the central locking spring 6*a* and the locking spring 6*b*, respectively, of each carrier plate 6. Opposite stopping grooves 4*c* of each cable connector 1 come into contact with the large stopper 6*c* and the small stopper 6*d*, respectively, of the carrier plate 6. Thus, the cable connector 1 is stably held on the carrier plate. In the state, the cable can be bent adjacent the cable connector 1 with an angle shown at A in the figure, as it is necessary. Since impedance matching is performed in the cable 3, turbulence of the impedance does hardly occur even if the angle portion A is formed at the cable 3.

Figure 5:
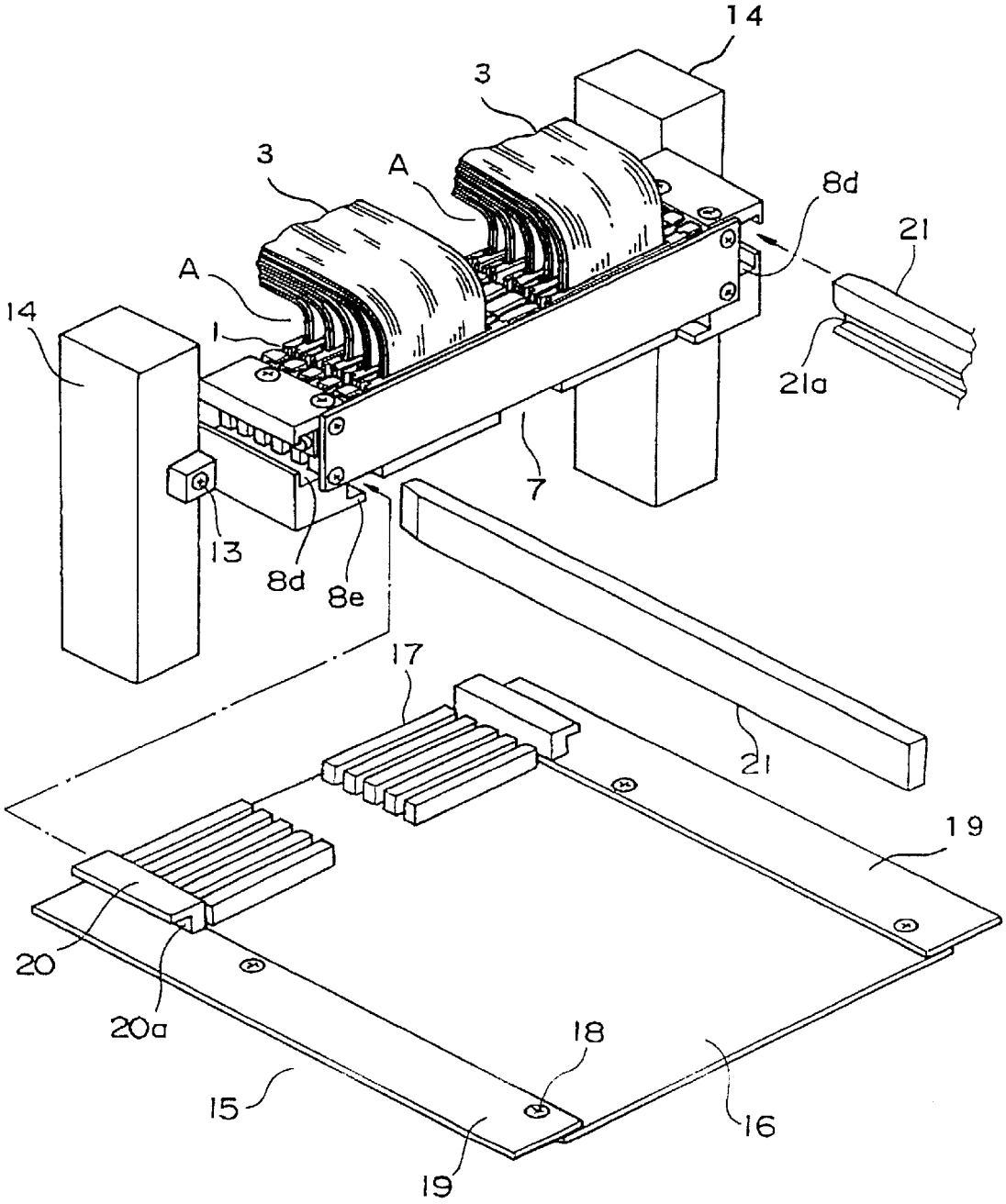
FIG. 5 is a perspective view showing the carrier assembly mounted on at a pair of pillars with cable connector being supported on the carrier plates, together with a card having board or header connectors and a pair of sliders to be fitted to the carrier assembly.

Referring to FIG. 5, all cable connectors 1 (ten cable connectors are shown) are disposed in two rows on the carrier assembly 7. In the state, a pair of sliders 21 are slidably fitted in the horizontal guide grooves 8*d*, respectively, and are attached to the carrier assembly 7 to connect the cable connectors 1 with header connectors on the card 15. Thus, the connector engaging/disengaging device is completed.

Figure 8:
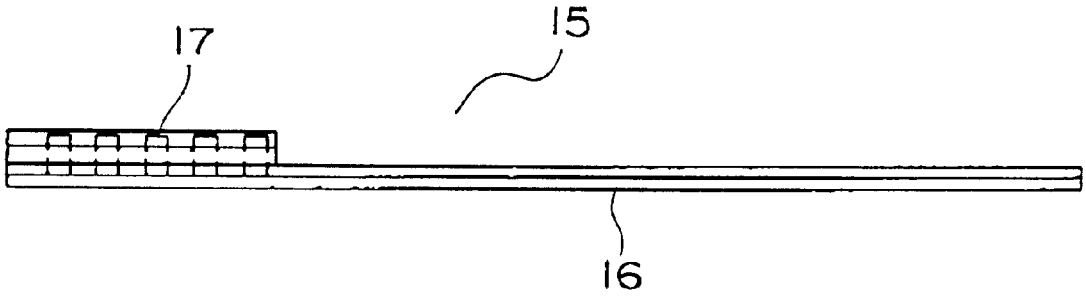
FIG. 8 is a side view of the card.
Figure 9:
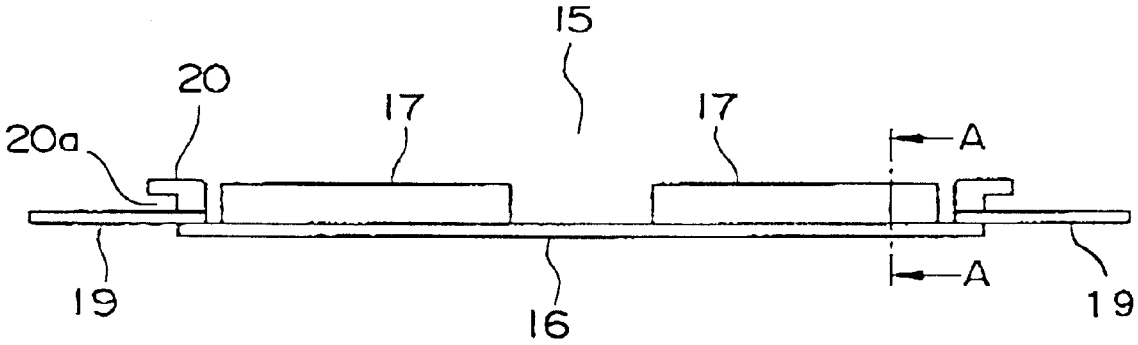
FIG. 9 is a front view of the card.

Referring now to FIGS. 5, 8 and 9, the description will proceed to the card 15. The card 15 comprises a printed circuit board 16, ten header connectors 17 all disposed on a surface of the printed circuit board 16, a pair of flanges 19 fixed on opposite side portions of the printed circuit board 16 by means of screws 18, and a pair of generally L-shaped guide members 20 is fixed to flanges 19, respectively. The ten header connectors 17 are disposed in two rows each having five connectors. The guide members 20 are disposed adjacent to two header connector rows, respectively. Thus, a gap 20*a* is formed between the flange 19 and a foot of "L" of the L-shaped guide member 20.

Figure 6A:
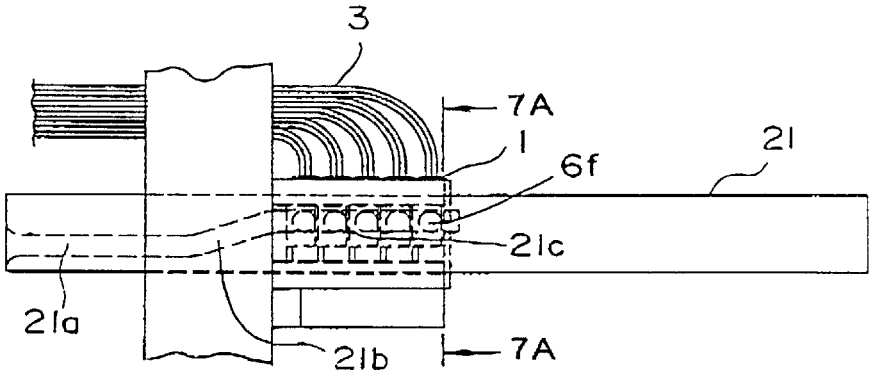
FIGS. 6A–6C are side view showing three different states of the connector engaging/disengaging device in a connecting process of the cable connectors to connectors on the card.
Figure 6B:
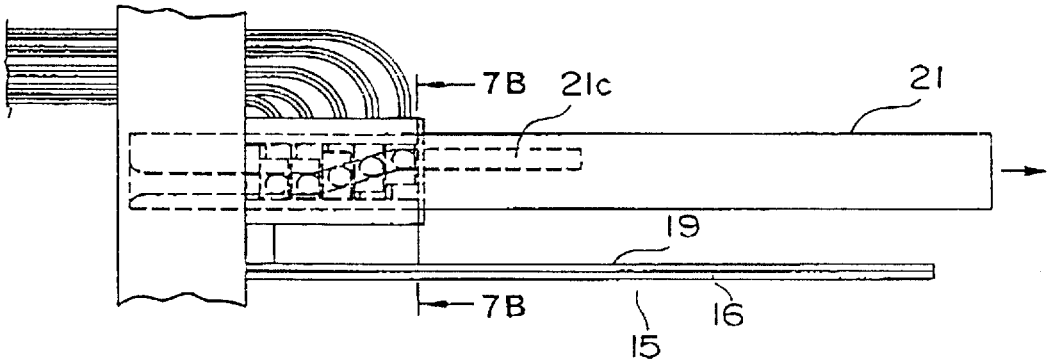
Figure 6C:
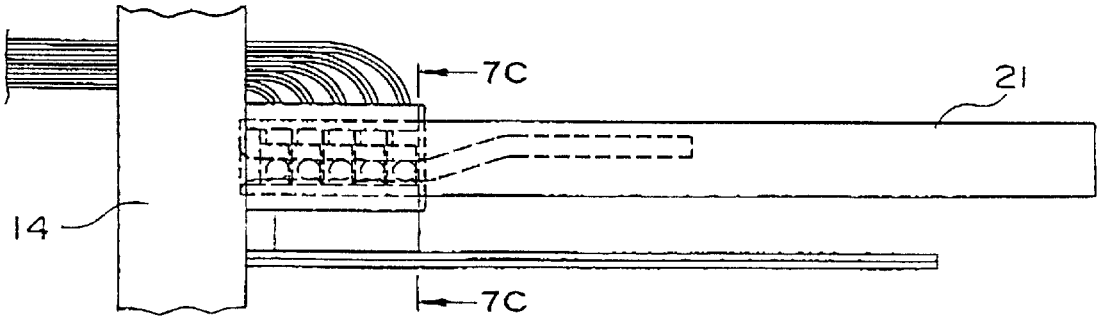

Referring to FIGS. 6A–6C in addition to FIG. 5, the description will proceed to each slider 21. Each of the sliders 21 is a rectangular rod and has a slider groove formed in the inner side surface and extending in the lengthwise direction of the rod for receiving the bosses 6*f* of the carrier plates 6. The slider groove comprises a first straight groove portion

21*a*, an inclined groove portion 21*b*, and a second straight groove portion 21*c* which are connected in series in this order, The second straight groove portion 21*c* is offset upwardly from the first straight groove portion 21*a* through the inclined groove portion 21*b*. Therefore, the inclined groove portion 21*b* goes up from the first straight groove portion 21*a* to the second straight groove portion 21*c*.

Figure 7A:
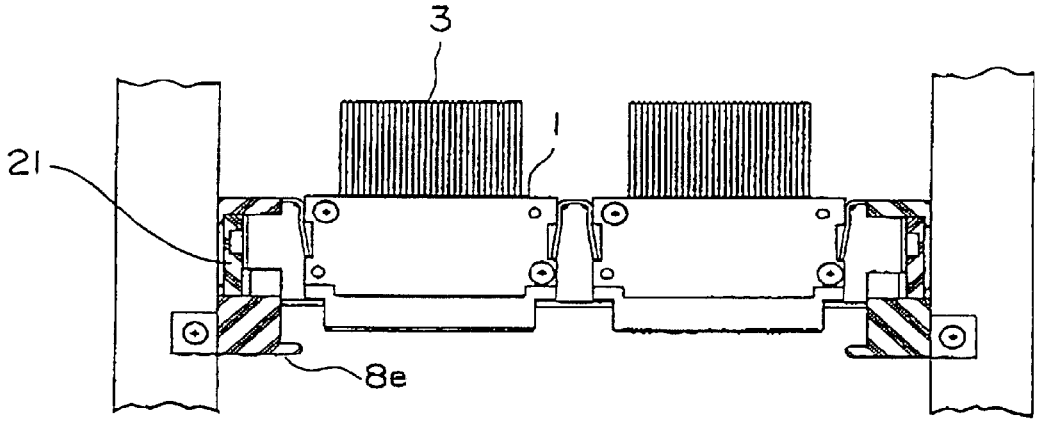
FIGS. 7A–7C are sectional views taken along lines 7A—7A, 7B—7B, and 7C—7C in FIGS. 6A–6C, respectively.

In the state shown in FIG. 5, when each slider 21 is inserted into the horizontal guide groove 8*d* of each side block 8 while the bosses 6*e* of the carrier plates 6 are received in the slider groove, the carrier plates 6 and therefore the cable connectors 1 are moved upwardly as the bosses 6*f* transit from the first straight groove portion 21*a* to the second straight groove portion 21*c* through the inclined groove portion 21*b*. The state of the carrier plates 6 are elevated is shown in FIG. 6A and FIG. 7A.

Next, the card 15 is attached to the connector engaging/disengaging device by inserting the support flanges 8*e* of the side blocks 8 into the gaps 20*a* of the card 15 until each flange 19 of the card 15 runs against each pillar 14, as shown in FIG. 6B. As a result, the card 15 is mounted on the carrier assembly 7, and each cable connector 1 and each header connector 17 are positioned facing each other., as shown in FIG. 7B.

Thereafter, when the sliders 21 are synchronously drawn out and slid to the direction shown by an arrow in FIG. 6B, bosses 6*f* of the five carrier plates 6 are pushed down successively by engaging with the inclined groove portion 21*b* of each slider 21. Thereupon, the ten cable connectors 1 are successively brought into engagement with the ten header connectors 17. When all of bosses 6*f* engage with the first straight groove portions 21*a*, all of the cable connector 1 are brought into the completion of engagement with the all of the header connectors 17, as shown in FIG. 6C and FIG. 7C. The connection completed state is maintained even if cable connectors 1 are pulled by cables 3. This is because cable connectors 1 are locked to the carrier plates 6 by locking springs 6*a* and 6*b* while the carrier plates 6 are prevented from moving by engagement of the bosses 6*f* with the first straight groove portions 21*a* in the slider 21.

Figure 7B:
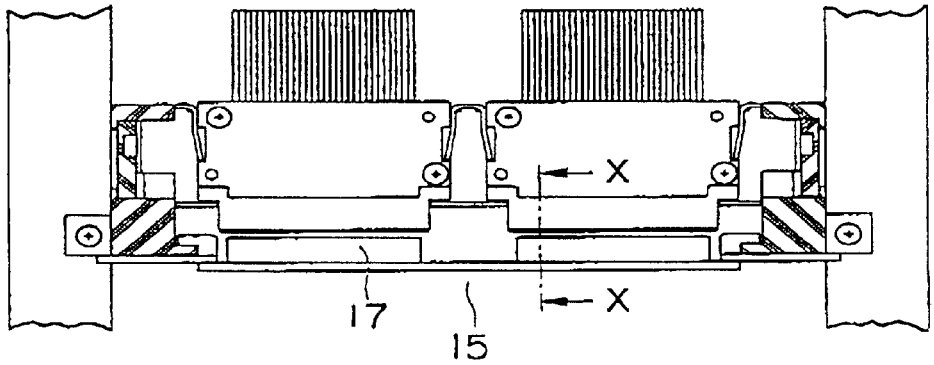
Figure 7C:
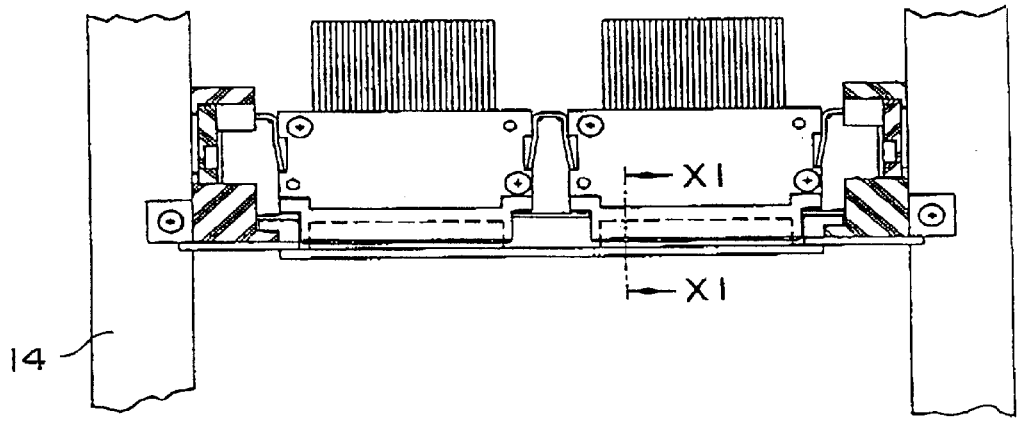
Figure 10:
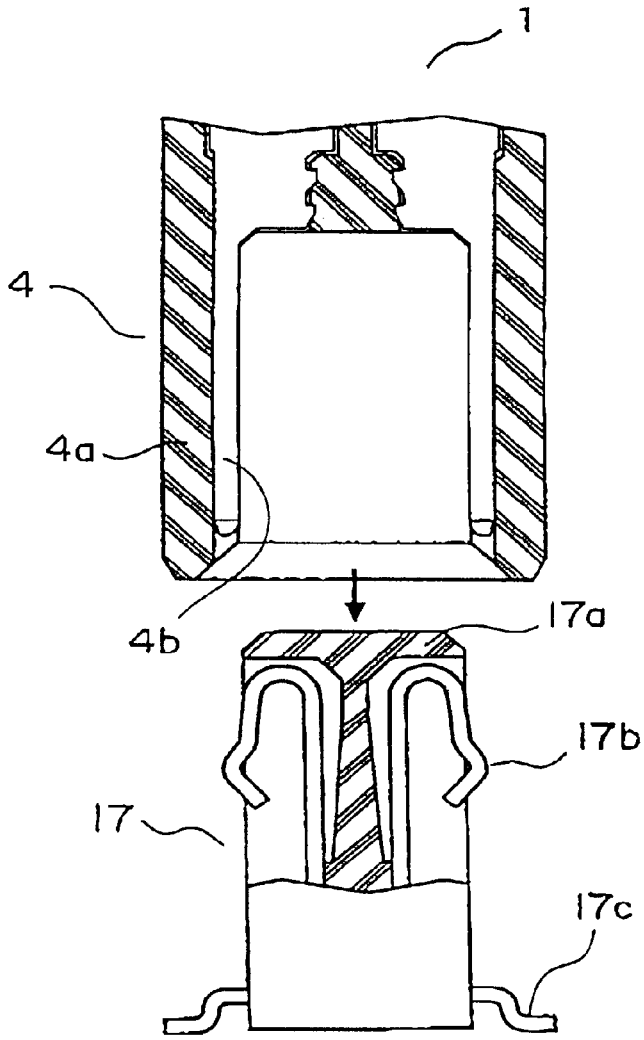
FIG. 10 is a sectional view taken along a line X—X in FIG. 7B.

Referring to FIG. 10 which shows, in sectional views, a positional relation of the fitting portion 4 of the cable connector 1 and the header connector 17 in the state shown in FIGS. 6B and 7B, the fitting portion 4*a* of the cable connector 1 comprises a housing 4*a* and contact elements 4*b* preserved in the housing 4*a*. The header connector 17 comprises an insulator housing 17*a* and contact elements 17*b* fixed in the housing 17*a*. Each of contact elements 17*b* has contact portion to be connected to each of contact elements 4*b* and a surface mounting terminal 17*c* which is connected onto the printed circuit board (16, in FIG. 6).

In transition of cable connectors 1 from the state in FIGS. 6B and 7B to another state in FIGS. 6C and 7C, the engaging portion 4 moves to a direction of an arrow shown in FIG. 10.

Figure 11:
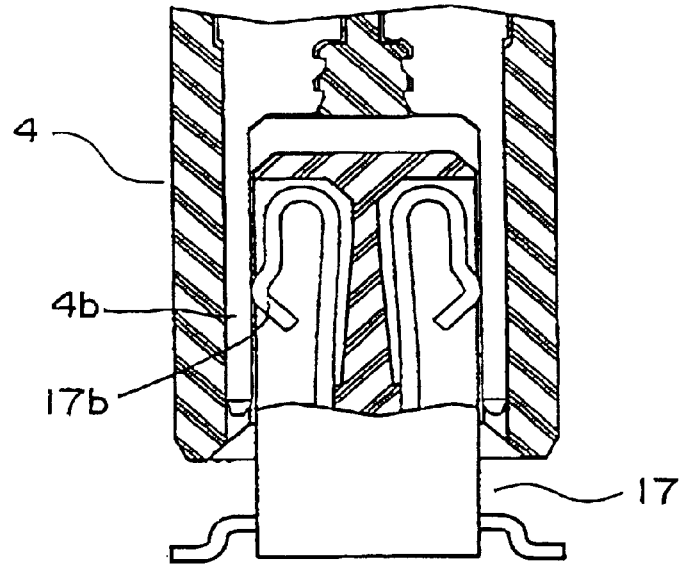
FIG. 11 is a sectional view taken along a line XI—XI in FIG. 7C.

Referring to FIG. 11 which shows, in sectional views, a positional relation of the fitting portion 4 of the cable connector 1 and the header connector 17 in the state shown in FIGS. 6C and 7C, the fitting portion 4 of the cable connector 1 is fit to the header connector 17. Consequently, each contact element 4*b* of the cable connector 1 comes into contact with each contact element 17*b* of the header connector 17. At this time, each contact element 17*b* is elastically deformed to provide a contact pressure to the contact element 4*b*.

In operation for separating each cable connector 1 from each header connector 17, the pair of sliders 21 are moved in a reversed direction and are drawn out from the carrier assembly 7. As a result, cable connectors 1 are moved upwardly in transition of states from FIGS. 6C and 7C to FIGS. 6A and 7A through FIGS. 6B and 7B.

What is claimed is:

1. A connector engaging/disengaging device for connecting/disconnecting between first electrical connectors and second electrical connectors which comprises:

at least one carrier plate adapted to carry said first electrical connectors thereon and having opposite end portions in a first direction, said end portions having engaging bosses projecting from said end portions in said first direction;

a support member supporting said at least one carrier plate slidable in a second direction perpendicular to said first direction and having slider guide grooves extending in a third direction perpendicular to said first and second direction, said support member having support portions adapted to support said second connectors so that said second electrical connectors face said first electrical connectors carried on said at least one carrier plate; and a pair of slider rods assembled in said support members slidable in said slider guide grooves in said third direction, said slider rods having slider grooves engaging said engaging bosses of said at least one carrier plate so that said at least one carrier plate is moved in said second direction by slide of said slider rods in said third direction so as to perform connection and disconnection of said first electrical connectors with said second electrical connectors.

2. A connector engaging/disengaging device as claimed in claim 1, wherein each of said slider groove comprises a first straight groove portion extending in said third direction, second straight groove portion extending in said third direction but offset from said first straight groove portion in said second direction, and an inclined groove portion connecting between said first straight groove portion and said second straight groove portion.

3. A connector engaging/disengaging device as claimed in claim 1, wherein said first electrical connectors are cable connectors and said second electrical connectors are header connectors mounted on a printed circuit board.

4. A connector engaging/disengaging device as claimed in claim 3, wherein said support portions of said support member are support flanges, said printed circuit board having a pair of flanges fixed at opposite sides thereof and a pair of L-shaped guide portions fixedly mounted on said flanges to form gaps between said flanges and foots of "L" of said L-shaped guide portions, said printed circuit board is attached to said support member by said support flanges of said support members being inserted in said gaps.

5. A connector engaging/disengaging device as claimed in claim 1, wherein the shape of said at least one carrier plate is in a generally rectangular form having an upper side and a lower side in said second direction and opposite ends in said first direction, said carrier plate has a generally U-shaped locking spring at the center thereof in said first direction and generally L-shaped locking springs at both the ends thereof, a first stopper on the lower side at the center in said first direction and second stoppers on the lower side at both the ends thereof, said carrier plate further having generally L-shaped projecting portions formed at said both end portions with said bosses being fixed on said projecting portions, respectively.

6. A connector engaging/disengaging device as claimed in claim 1, wherein said support member comprises a pair of side blocks, and a front plate fixed onto front surfaces of said side blocks to thereby joint said side blocks.

7. A connector engaging/disengaging device as claimed in claim 6, wherein each of said side blocks has vertical guide grooves in said second direction and receiving said L-shaped projecting portions slidable therein in said second direction, stopper plates are fixedly mounted onto said side blocks to prevent said L-shaped projecting portions from going out of said vertical guide grooves.

* * * * *